United States Patent [19]

White

[11] 3,977,642

[45] Aug. 31, 1976

[54] SUPPORT STRUCTURE

[75] Inventor: Bobbie L. White, Shreveport, La.

[73] Assignee: Gym-Dandy, Inc., Bossier City, La.

[22] Filed: Feb. 24, 1975

[21] Appl. No.: 552,370

[52] U.S. Cl. ..... 248/309 R; 248/172; 248/279

[51] Int. Cl.[2] ..... A47F 5/00

[58] Field of Search ..... 248/309, 241, 244, 251, 248/121, 122, 124, 274, 278, 279, 287, 40, 42, 258, 260, 157, 419, 420, 172; 135/49, 50; 403/4, 388, 408, 108, 378; 211/182; 52/758 N, 754, 753 H, 633; 40/27, 28, 29

[56] References Cited

UNITED STATES PATENTS

| | | | |
|---|---|---|---|
| 314,808 | 3/1885 | Denecke | 248/121 |
| 1,996,722 | 4/1935 | Gilbert et al. | 46/29 |
| 3,117,760 | 1/1964 | Presbach et al. | 248/188.5 |
| 3,627,244 | 12/1971 | Nicholas | 248/279 |

*Primary Examiner*—Robert A. Hafer

*Attorney, Agent, or Firm*—Strauch, Nolan, Neale, Nies & Kurz

[57] ABSTRACT

The hollow inclined legs of a gym assembly are each telescopingly mounted on the angularly upwardly extending arms of an angle bracket, each angle bracket in turn having a horizontal arm provided with a series of apertures for selective connection to an upright anchor bracket fixed to a gondola or like support. The effective length of the horizontal arm may be selectively increased by a sleeve telescopingly fitted over the horizontal arm.

9 Claims, 11 Drawing Figures

FIG. 1
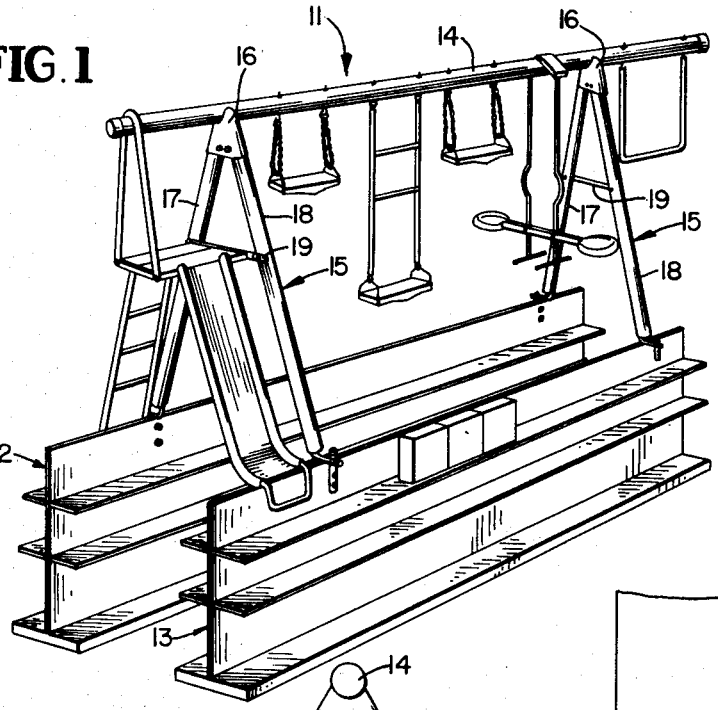
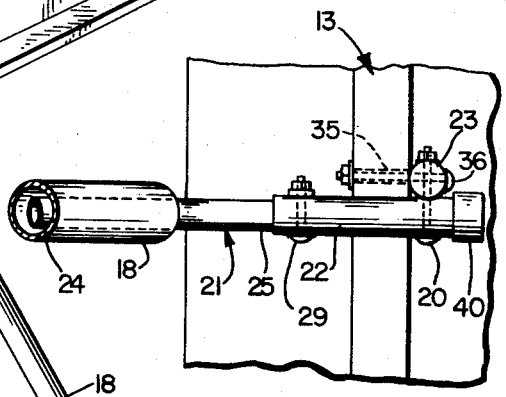
FIG. 3
FIG. 2
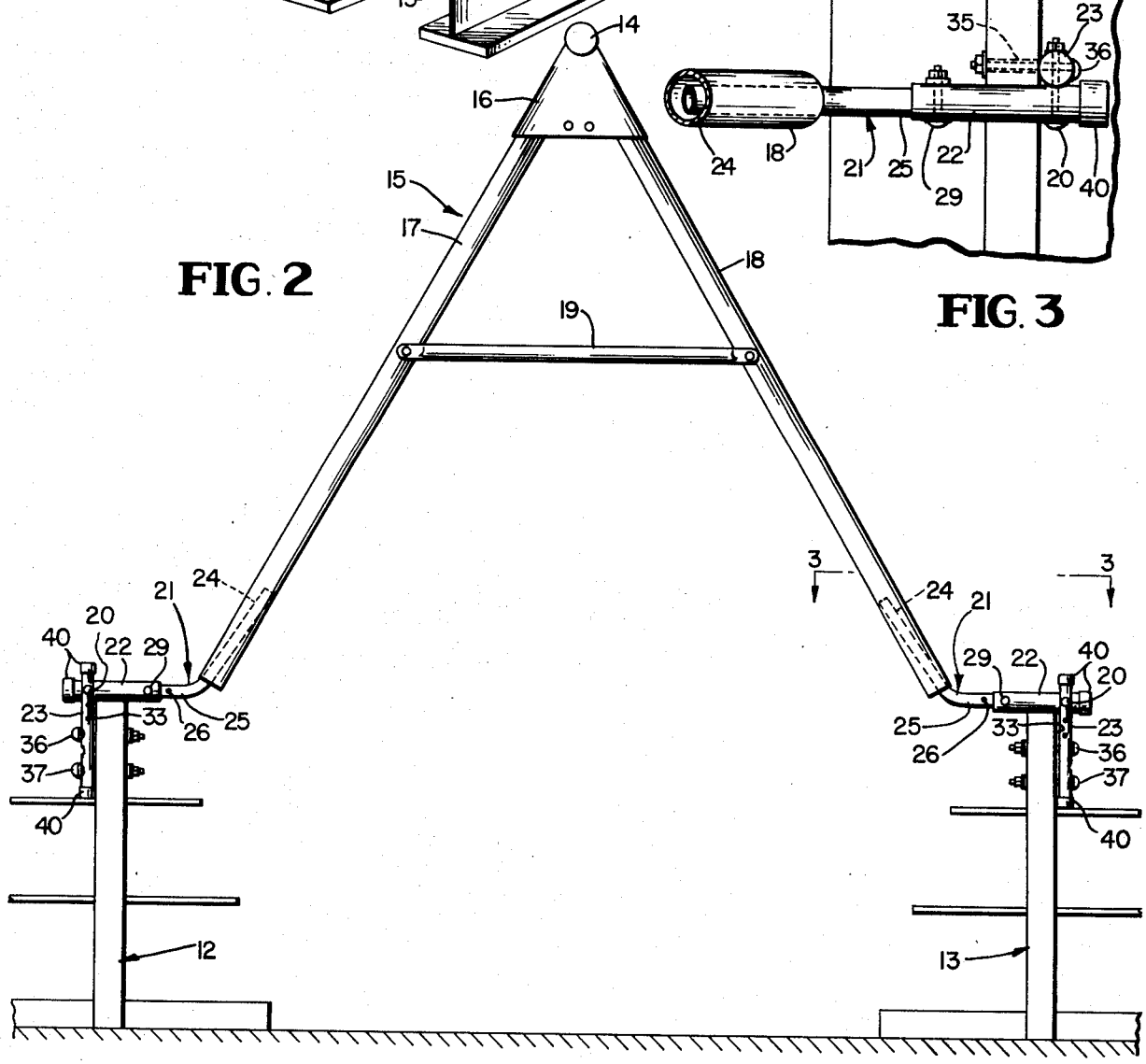

SUPPORT STRUCTURE

This invention relates to adjustable support structure for mounting equipment assemblies, and in its preferred embodiment will be described as adjustable bracket structure for the mounting of a gymnasium equipment assembly on randomly spaced supports mainly for display purposes.

In department and like large stores it is conventional for a manufacturer to install displays of its goods for demonstrating quality and appearance. Often these displays when on the floor may be effectively hidden by other objects or otherwise may not stand out desirably. In such stores it is conventional to provide long shelf structure sometimes known as gondolas for storing and displaying goods, and often displays are mounted on the upper ends of these structures which serve essentially as supports.

The present invention contemplates primarily a special selectively combinable bracket structure whereby an otherwise conventional display assembly such as an assembly of gymnasium components in operative relation, may be mounted upon and across the upper ends of two adjacent gondolas whereby the display may be readily mounted on existing supports so that it will occupy an elevated unobstructed position demanding attention from nearby customers. This is a major object of this invention.

It will be understood that while the invention will be disclosed for mounting a gymnasium display upon supporting gondolas, the bracket structure as will appear in the claims is effectively applicable to the mounting of other assemblies on suitable supports.

A major object of the invention is therefore to provide a novel useful bracket structure.

It is a further object of the invention to provide a novel bracket structure comprising selectively connectable elements that may be selectively relatively adjustable in assembly to coact with both an assembly to be supported and available supports.

Further objects of the invention comprise a novel assembly of bracket elements wherein a special angle bracket has one arm adapted for connection to a device to be supported and the other arm adapted for selectively adjustable connection directly or through a telescoped extension sleeve to an anchor bracket which in turn is attached to a support such as a gondola. Further and more specific to this object the first angle bracket arm may be adapted to extend angularly upwardly into the hollow inclined leg of a gymnasium assembly to be supported while the other arm is generally horizontal and has effective selectively established or adjustable connection to a special upright anchor bracket secured to a support, there being a bracket assembly for each leg of the gymnasium assembly.

A further object of the invention is to provide a novel integral angle bracket of bent tubular stock wherein the respective arms include predetermined obtuse or acute angles and one of the arms has a series of longitudinally spaced diametral apertures for selective attachment during assembly.

Another object of the invention is to provide a novel anchor consisting essentially of a straight rigid tube having at opposite ends two sets of longitudinally spaced attachment apertures, the sets extending at right angles to each other.

Further novel features and other objects of this invention will become apparent from the following detailed description, discussion and the appended claims taken in conjunction with the accompanying drawings.

BRIEF DESCRIPTION OF DRAWINGS

FIG. 1 is a generally perspective diagrammatic view showing the invention in a one environment;

FIG. 2 is an end view showing a preferred embodiment of the invention;

FIG. 3 is an enlarged fragmentary view showing detail;

PREFERRED EMBODIMENTS

Figure 5:
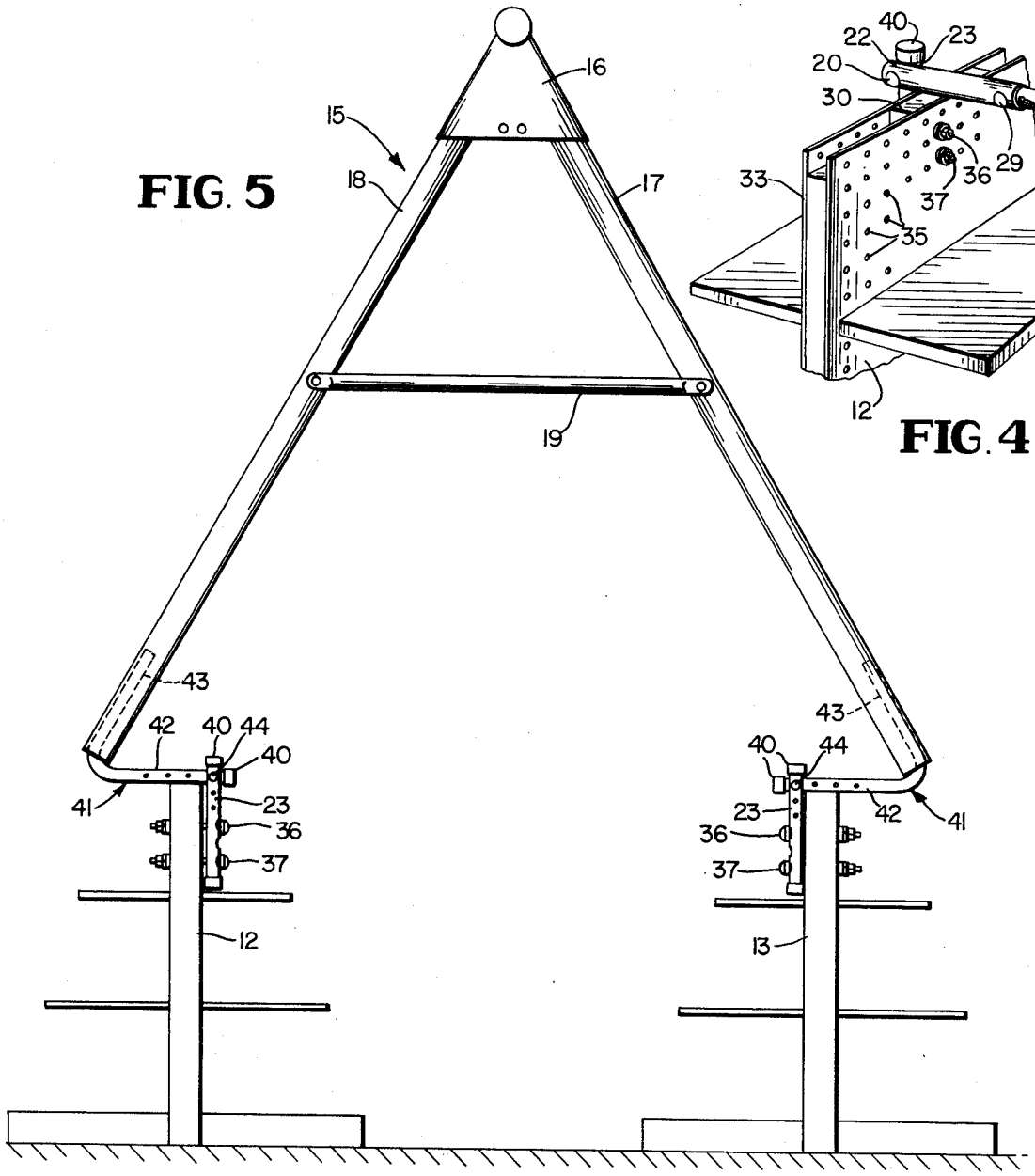
FIG. 5 is an end view like FIG. 2 showing another embodiment.

Referring to FIG. 1 a gym assembly 11 is mounted on spaced parallel gondolas 12 and 13 that seat flatly and firmly on a horizontal cement or like floor and preferably are secured against movement with respect to the floor. As shown the gondolas are of the usual shelf type and are preferably of the same height.

The gym assembly is relatively conventional and comprises an upper generally horizontal bar 14 from which various exercise devices are suspended as shown, and spaced inverted-V identical leg assemblies 15. Each leg assembly 15 has a rigid welded joint connection 16 at its upper end fixedly supporting bar 14, and the downwardly diverging legs are rigid hollow metal tubes 17 and 18 open at their lower ends. Usually, a rigid cross brace 19 is connected between each pair of legs 17 and 18.

The invention herein will be described as providing special bracket structures for supporting and attaching the lower ends of the leg assemblies 15 on the gondolas, and the several embodiments shown in FIGS. 2, 5 and 6 for example illustrate different combinations of bracket parts involved to suit different gondola spacing and/or differently angled legs 17 and 18.

Figure 4:
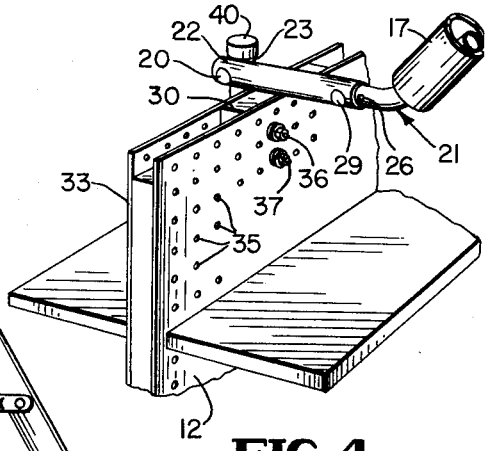
FIG. 4 is a fragmentary top plan view showing the angle bracket to sleeve connection.

Referring to FIGS. 2–4, the illustrated support connection between the lower end of a hollow leg (17 or 18) and the associated gondola consists basically of an angle bracket 21, a sleeve 22, an anchor bracket 23 and suitable fastening elements such as bolts as will appear. As will appear in connection with FIG. 5, in some installations the sleeve may not be used.

Figure 7:
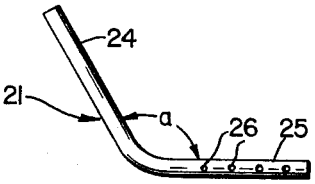
FIGS. 7 and 8 are side elevations of different angle brackets.
Figure 10:
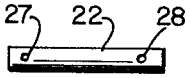
FIG. 10 is a side elevation of a sleeve.
Figure 11:
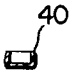
FIG. 11 shows a plastic cap that fits over the exposed bracket arm or sleeve ends.

FIG. 7 shows an angle bracket 21. It is a bent section of tubing that has arms 24 and 25 extending in fixed relation to define an obtuse angle, and one arm 25 has a longitudinally spaced and longitudinally aligned series of diametral apertures 26. The non-apertured arm 24 is preferably of smaller diameter than the associated hollow gym leg so that it readily slidably extends upwardly thereinto as shown in FIG. 2. By having the arm diameter less than the internal diameter of the leg, small differences in angularity between arm 25 and the leg are permitted, and exact correspondence of angularity is not necessary. The apertured arm 25 extends horizontally across the flat top of the associated gondola, and sleeve 22 is a rigid straight tubing section of such diameter as to be snugly slidably telescoped upon arm 25 to effectively lengthen arm 25. Sleeve 22 (FIG. 10) has diametral apertures 27 and 28 at opposite ends, and a fastener 29 extends through a sleeve aperture and a selected one of the angle bracket arm apertures 26 to secure the sleeve on arm 25. The necessary degree of extension of arm 25 is usually determined and then a sleeve aperture is aligned with the nearest aperture 26 through which fastener 29 is to be passed.

Since bracket arm 25 alone, or as lengthened by sleeve 22, is horizontal in this assembly the obtuse angle *a* between arms 24 and 25 is the supplement of the angle each gym leg 17 or 18 makes with the horizontal. In practice several of these angular brackets with different inclined angles may be provided in a kit so that the ones having the proper angular relation may be incorporated into the assembly.

Figure 9:
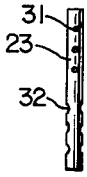
FIG. 9 is a side elevation of an anchor bracket.

As shown in FIGS. 2 and 9, the straight upright anchor bracket 23 is a rigid length of tubing having at one end a series of diametral apertures 31 and at the opposite end a series of diametral apertures 32 that extend at right angles to apertures 31. In the assembly the anchor bracket 23 is disposed substantially vertically alongside the vertical face 33 of the associated gondola with one of the upper set of apertures 31 aligned with an end aperture of the sleeve 22, and preferably at least two of the lower set of apertures 32 aligned with two through apertures 35 existing or formed in bracket mounting means on the gondola. Fasteners 36 and 37 extend through these respective aligned apertures to fix the anchor bracket on the gondola. A fastener 20 extends through a sleeve aperture such as 27 and an aligned anchor bracket aperture 31 to secure the anchor bracket 23 to sleeve 22. In the resultant assembly, telescopingly fitted plastic caps 40 are placed over the exposed upper end of the anchor bracket and the sleeve end as shown.

Referring to FIG. 4, should the gondola be of the type having a channel at its upper end a reinforcing block of wood or like material 30 is preferably inserted into the channel below the sleeve as shown.

Figure 6:
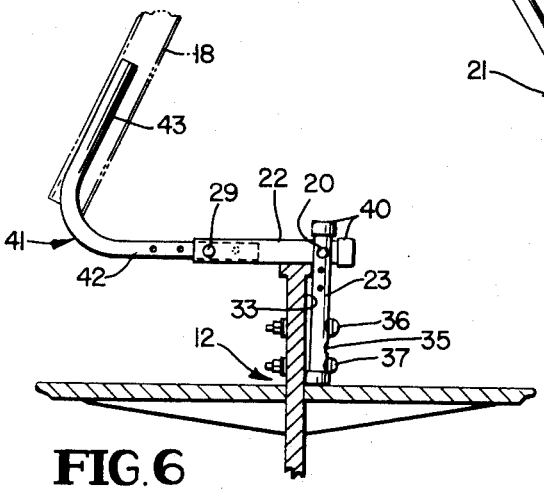
FIG. 6 is a fragmentary end view showing another leg bracket to gondola connection.
Figure 8:
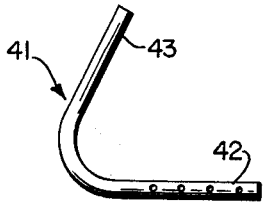

Referring now to FIGS. 5–7 the gym assembly 11 is mounted on gondolas 12 and 13 that are more closely spaced than in FIGS. 1 and 2. Here the lower ends of the hollow legs 17,18 fit over angle brackets 41 such as shown in FIGS. 5 and 8 that have an apertured leg 42 at an acute angle to the non-apertured leg 43.

In this embodiment the upright anchor brackets 23 are secured at their lower ends to the gondola inner side by fasteners 36,37. The upper end of each anchor bracket 23 is secured directly to the horizontal apertured leg 42 of the angle bracket as by a fastener 44, no sleeve extension being required.

FIG. 6 shows a bracket structure wherein an acute angle bracket 41 is used with an extension sleeve 22, where the gondolas may be slightly further apart than in FIG. 5.

In all embodiments of the invention the hollow legs of the gym assembly are essentially telescopingly mounted on angularly extending arms of an angle bracket, each angle bracket in turn having a horizontal arm provided with a series of apertures for selective connection to an upright anchor bracket fixed to the gondola. The effective length of the horizontal arm may be selectively increased by a sleeve telescopingly fitted over the horizontal arm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for mounting an assembly having a plurality of angularly downwardly extending downwardly open legs upon upright support means comprising bracket mounting means on said support means and bracket structure at each leg including angle bracket means having an upwardly angularly extending arm for telescopic connection to the associated leg and generally horizontal arm means adapted to extend adjacent said mounting means and provided with a plurality of through fastener receiving apertures that are longitudinally spaced and longitudinally aligned, an upright anchor bracket having at each opposite end a set of longitudinally spaced and longitudinally aligned fastener receiving apertures, the apertures of each set extending at substantially right angles to the apertures of the other set, means for securing said angle bracket means to said anchor bracket comprising fastener means passing through an aperture of the upper of said sets and an aperture of said apertured arm means, and means for securing the bracket structure to said support means comprising fastener means extending through at least one of said lower set of apertures in the anchor bracket to said mounting means.

2. The apparatus defined in claim 1, wherein said angle bracket means comprises an angle bracket member having a generally horizontal arm, and an extension member is fixed on said horizontal arm and fastened to the upper end of said anchor bracket.

3. The apparatus defined in claim 1, wherein said angle bracket means is a single angle bracket member formed of relatively stiff tubing bent to provide arms extending at predetermined angularity, with the apertures formed diametrally in the generally horizontal arm.

4. The apparatus defined in claim 1, wherein said angle bracket means comprises an angle bracket member formed of relatively stiff tubing bent to provide arms extending at predetermined angularity, with some of said apertures formed diametrally in the generally horizontal arm, and a sleeve extension is provided for said generally horizontal arm, said sleeve having at least one fastener securing diametral aperture aligned with an aperture in said substantially horizontal arm, and at least one other fastener receiving aperture aligned with one of the upper set of apertures of the anchor bracket.

5. The apparatus defined in claim 1, wherein said angle bracket means comprises a length of stiff tubing bent to predetermined angularity to provide an angle bracket member having angularly extending and generally horizontal arms, and said anchor bracket comprises a straight stiff length of tubing wherein the aperture sets are diametral.

6. The apparatus defined in claim 5, wherein an extension sleeve is telescoped over said generally horizontal arm, and the sleeve is fastened at opposite ends to said generally horizontal arm and said anchor bracket.

7. In the apparatus defined in claim 1, said bracket mounting means comprising a fixed generally vertical multi-apertured panel.

8. In combination with a display of the type having at least four inclined downwardly open hollow legs, means for mounting said display upon a support structure comprising bracket mounting means on said support structure, a bracket structure adapted to be secured on the support structure at the lower end of each leg, each said bracket structure comprising an angle bracket having an arm extending angularly upwardly within its associated leg and a generally laterally extending apertured arm, and an upright anchor bracket fixed at its lower end on the said mounting means and having an apertured upper end fastened to said apertured arm.

9. In the combination defined in claim 8, said laterally extending arm including a telescoped sleeve extension.

* * * * *